US006490759B1

(12) United States Patent
Brueckner et al.

(10) Patent No.: US 6,490,759 B1
(45) Date of Patent: Dec. 10, 2002

(54) MOTOR VEHICLE HINGE WITH A BRAKING AND HOLDING FUNCTION

(75) Inventors: Lothar Brueckner, Iconberg; Nils Magnus, Remscheid, both of (DE)

(73) Assignee: Ed. Scharwaechter GmbH, Remscheid (DE)

( * ) Notice: Subject to any disclaimer, the term of this patent is extended or adjusted under 35 U.S.C. 154(b) by 0 days.

(21) Appl. No.: 09/647,008

(22) PCT Filed: Jan. 28, 1999

(86) PCT No.: PCT/DE99/00254

§ 371 (c)(1),
(2), (4) Date: Dec. 11, 2000

(87) PCT Pub. No.: WO99/49164

PCT Pub. Date: Sep. 30, 1999

(30) Foreign Application Priority Data

Mar. 26, 1998 (DE) ..... 198 13 520

(51) Int. Cl.[7] ..... E05D 11/02
(52) U.S. Cl. ..... 16/342; 16/274
(58) Field of Search ..... 16/342, 274, 373; 277/628, 602

(56) References Cited

U.S. PATENT DOCUMENTS

| | | | | | |
|---|---|---|---|---|---|
| 757,784 | A | * | 4/1904 | Skilton | 16/274 |
| 1,180,336 | A | * | 4/1916 | Sundh | 16/274 |
| 4,575,914 | A | * | 3/1986 | Armida et al. | 16/274 |
| 5,092,017 | A | * | 3/1992 | Hatano et al. | 16/342 |
| 5,906,029 | A | * | 5/1999 | Fox | 16/386 |

FOREIGN PATENT DOCUMENTS

| | | |
|---|---|---|
| DE | 4406824 | 9/1995 |
| EP | 0691448 | 1/1996 |
| FR | 2442326 | 6/1980 |
| FR | 2670530 | 6/1992 |

* cited by examiner

*Primary Examiner*—Anthony Knight
*Assistant Examiner*—Doug Hutton
(74) *Attorney, Agent, or Firm*—Davidson, Davidson & Kappel, LLC

(57) ABSTRACT

The invention relates to motor vehicle door hinges with a braking and holding function, consisting of a first hinge half (1) which can be fixed to a door assembly part, door or door post, a second hinge half (2) which can be fixed to the other door assembly part and a hinge pin (3) which consists of a solid material and which connects the two hinge halves (1,2) in such a way that they pivot. The hinge pin (3) is connected to the gudgeon (5) of one hinge half (2) in such a way that it is rotationally fixed and is mounted in the gudgeon (4) of the other hinge half (1) with a running fit. The curvature (7) of the cross-section of said hinge pin also deviates from that of a perfect circle at least over a section (6) of the longitudinal part of the hinge pin which is associated with the particular gudgeon (4), this corresponding with a complementary configuration of the gudgeon bore of the gudgeon of the hinge half in which the hinge pin is mounted with its running fit. In order to ensure that the braking and holding force remains constant with a constant door-opening angle over the entire lifetime of the hinge, the gudgeon bore of the gudgeon (4) in which the hinge pin is mounted with a running fit is sealed steam-tight at both ends, as far as the hinge pin.

13 Claims, 4 Drawing Sheets

MOTOR VEHICLE HINGE WITH A BRAKING AND HOLDING FUNCTION

FIELD OF THE INVENTION

Motor-vehicle hinge having a braking and holding function, consisting of a first hinge half which can be fixed to a door assembly part, door or door strut, and of a second hinge half which can be fixed to the other door assembly part, and also of a hinge pin which is made of solid material, connects the two hinge halves pivotably to each other, is connected to the gudgeon of the one hinge half in a rotationally secure manner and is mounted in the gudgeon of the other hinge half with a running fit, the hinge pin, in conjunction with a complementary design of the hole of the gudgeon of that hinge half in whose gudgeon it is mounted with a running fit, having, at least over part of its longitudinal region which is assigned to this gudgeon, a rounded profile of its cross section which deviates from-the. pure circular shape.

BACKGROUND INFORMATION

Motor-vehicle door hinges fitted in this manner are particularly distinguished in that they make it possible to produce the holding and securing functions, which have hitherto and conventionally been produced by door stops formed by special components, for braking and securing a vehicle door in the partially open range, i.e. conventionally in an opening angle range with opening angles of between 20 and 70°. The holding and securing function, which, depending on the door equipment and therefore door weight, requires a force of 50 N and also more, is derived from the fact that the hinge pin, in conjunction with a complementary design of the gudgeon hole of the gudgeon of that hinge half in whose gudgeon it is mounted with a running fit, has a rounded profile of its cross section which deviates from the pure circular shape in such a manner that when there is a mutual pivoting of the two hinge halves, the rounded deviations in the hinge pin diameter and optionally in the gudgeon hole run onto one another and force an elastic deformation at least one of the two parts—the gudgeon or hinge pin, preferably of part of the wall thickness of the gudgeon. In this case, the deformation force is used as a braking and holding force for securing the motor-vehicle door in a selected partially open position determined by the geometrical position of the rounded deviations of at least the hinge pin. For motor-vehicle doors it is very important, for different reasons, for example in order to avoid the door hitting against a garage wall, that the holding points in predetermined partially open positions of the door are observed exactly. Deviating from pure theory, the forces whose sum total produces the braking and holding force, for braking and securing the door in a certain partially open position, partly result merely from the deformation work during the elastic deformation of the material, but partly also from frictional forces which arise during the relative movement of the surfaces which interact together and are dependent to a substantial part on the composition of these surfaces. In order that a selected holding point of the door is always reliably kept to, it must therefore also be ensured that the requirements for producing the forces used for this purpose do not change, or in any case do not substantially change, over the working life of the hinge.

Motor-vehicle door hinges are not only mass-produced articles and as such can be produced cheaply or at least at good value, but they are also exposed, on the one hand, to very high temperature fluctuations, corresponding to the vehicle operating conditions, and, on the other hand, as part of the bodywork are also to an increased extent exposed to environmental influences. Temperature changes in the order of magnitude of several umpteen degrees can result in gap-width changes, even though these are reversible, which may, inter alia, have the consequence of foreign bodies penetrating into the hinge bearing arrangement. Whereas the penetration of granular foreign bodies, and to a certain extent also dust and relatively coarse dirt, into the bearing arrangement of the hinge pin is generally largely avoided by the means which are in any case customarily present on a hinge, such as stepped hinge-pin sections or shims and the like, in the known types of hinges there is no obstacle to the penetration of contaminants, as are present microscopically finely distributed in air, into the bearing arrangement of the hinge pin. The presence of such contaminants in the hinge bearing arrangement has hitherto also not been assigned particular importance although it was definitely known that such contaminants in conjunction with condensation water or steam which has penetrated form aggressive waters which can attack metallic surfaces.

The presence of aggressive waters or the like in the hinge bearing arrangement has serious significance if in connection with the production of braking and holding forces by elastic deformation of material in such a manner that during operation of the hinge surfaces of the hinge pin and gudgeon which interact in a sliding manner force a deformation of material in the elastic range.

In the case of motor-vehicle door hinges of this type, those surface regions of the hinge pin and gudgeon hole which interact with one another in order to produce a deformation of material, which can be used as a holding force, are designed such that they gradually slope up to a vertex in such a manner that the deformation of material, and therefore the holding force, increases with increasing opening or closing of the door until, at a holding point predetermined by the vertex of the upward slope of the interacting surface regions of the hinge pin and gudgeon hole, or at a predetermined partially open position, the maximum deformation of material, and therefore the maximum holding force, is achieved and the door is securely fixed in this position. The point to be started from here is that the retarding force for each door, which force is required in order to stop and secure the door, has a magnitude which can be determined from the outset and the braking and holding means have to be configured in such a manner that this retarding force is achieved at a certain door opening angle, constantly over the entire working life of the hinge. The retarding force required for stopping and securing the door is, in the case of hinges of the type under discussion here, of course applied partly, even if to a relatively small extent, by means of frictional forces between the interacting surfaces, the magnitude of the frictional forces which occur being very substantially dependent on the composition of the directly interacting surfaces. In particular, the frictional forces resulting from the interaction of the surfaces become greater as the surfaces become rougher. An impairment occurring over the course of time, in particular an impairment of the surface composition of the interacting surfaces, which impairment can be attributed to roughening due to the action of aggressive waters, necessarily results in a considerable increase in the frictional forces, the magnitude of which increase cannot be foreseen for an individual case, which results then in a premature reaching of the retarding force required for securing the door, with the result that the door already comes to a standstill before its predetermined holding position is reached and can only be fully opened or closed if an increased amount of force is exerted thereon. This uncertainty, which could not hitherto be overcome, with regard to predetermined holding points of the door always being precisely kept to, constitutes an obstacle to the practical use of hinges of the type described at the beginning.

SUMMARY OF THE INVENTION

The present invention is therefore based on the object of further improving a motor-vehicle hinge of the type described at the beginning in such a manner that the application of a constant braking and holding force in the case of an invariably constant door opening angle is ensured over the working life of the hinge.

According to the present invention, this object is achieved by the hole of that gudgeon in which the hinge pin is mounted with a running fit being sealed with respect to the hinge pin at both ends in a steam-tight manner. A steam-tight sealing of the gudgeon hole with respect to the hinge pin produces a certain assurance to the effect that even contaminants which are very finely distributed particularly in the air are unable to pass into the hinge bearing arrangement and in particular are unable to pass into the region of those surface regions of the hinge pin and gudgeon hole which are designed such that they gradually slope up and interact in order to produce a deformation of material which can be used as the holding force, with the result that the formation of aggressive waters or similar media which adversely affect or change the composition of the interacting surfaces is ruled out. In addition, a steam-tight sealing also has the advantage that even under the action of relatively high temperatures evaporation of corrosion-retarding media or lubricants present within the hinge bearing arrangement is avoided. Finally, a steam-tight sealing also opens up the possibility of accommodating a depot of corrosion-retarding media, even easily volatile media, within the hinge bearing arrangement.

With regard to the structural design of the steam-tight sealing of the hinge bearing arrangement, four different types are provided in principle, namely first of all a sealing of the gudgeon hole with respect to the hinge pin by soft-material seals which are under radial prestress. However, a design form which can be realized equally favorably can also provide a sealing of the gudgeon hole with respect to the hinge pin by sealing elements which are under axial stress. Moreover, for many cases of use, a contact-free sealing, in particular in the form of a labyrinth seal, may also be recommended. Finally, another design form for effective sealing of the gudgeon hole with respect to the hinge pin comprises providing a covering which fits over at least the head rollers of that hinge half in which the hinge pin is mounted with a running fit.

However, for practical use it is frequently expedient to realize the steam-tight sealing of the gudgeon hole with respect to the hinge pin by using two of the above-described design principles to the effect that sealing means which differ in design are used from the one to the other end of the gudgeon hole.

In a preferred form of implementation, provision may be made for the steam-tight sealing to be formed at least on one side by a deformation of the hinge pin and/or gudgeon wall, which deformation is directed radially with respect to the hinge axis. A radial deformation expediently of the hinge pin can be provided particularly at that end of the gudgeon hole which is assigned to the free end of the hinge pin, it being possible, given a suitable design, for the radial deformation at the same time also to form a rivet for the hinge pin.

In a first advantageous development of this form of implementation, provision can further be made for the steam-tight sealing to be formed by run-on washers braced axially against the end sides of the hinge part, in conjunction with a deformation of the free end of the hinge pin, which deformation is directed radially to the hinge axis.

In a further advantageous development of this form of implementation, provision can furthermore be made for the steam-tight sealing to be formed by run-on washers braced axially against the end sides of the gudgeon or of the hinge part, clamping the radial collar of bearing bushings designed as collar-type bushings, expediently in conjunction with a deformation of the free end of the hinge pin, which deformation is directed radially with respect to the hinge axis. Instead of a radial deformation of the hinge pin, an axial screw connection, for example, by means of a nut placed onto the free end of the hinge pin, which end is designed as a threaded stem, can, of course, also be provided in order to produce the required bearing pressure for axial sealing means, such as run-on washers or the collars of collar-type bushings.

In conjunction with at least one corresponding, radial projection of the hinge pin or in conjunction with the use of run-on washers braced against the end sides of the hinge part, provision can also be made in a modified design form for the steam-tight sealing to be formed by soft-material seals which bear under prestress against the end sides of the gudgeon or of the hinge part in which the hinge pin has a running fit.

In a second advantageous form of implementation, provision is made for the steam-tight sealing to be formed by contact-free sealing means, the contact-free sealing means for the steam-tight sealing preferably being formed by labyrinth seals.

In a practical design form of this form of implementation advantageous in particular for demountable hinges, provision is made for the labyrinth seals to be formed at one end by a cap which is placed onto the free end of the hinge pin and has a collar coaxial to the hinge pin, and at the other end by a collar which is fitted to a radial projection of the hinge pin and is coaxial to the hinge pin and in each case an axial annular groove, which is assigned to the particular collar, in the end surfaces of the gudgeon or of the hinge part of that hinge half in which the hinge pin has a running fit.

In addition, in an advantageous form of implementation comparable to the use of contact-free sealing means, and suitable for arrangement on that side of the hinge part which is assigned to the free end of the hinge pin, provision can also be made for the steam-tight sealing to be formed on one side by a cap which fits over the free end surface of that hinge part in which the hinge pin is mounted with a running fit, and bears in a sealing manner against the side surfaces of the hinge half.

Finally, according to a particular form of implementation, provision can also be made for the steam-tight sealing to be formed by a closed bellows which fits around the hinge parts of both hinge halves and in each case bears in a sealing manner against the hinge leaves.

BRIEF DESCRIPTION OF THE DRAWINGS

The present invention is described in detail in the following description of examples which reference to a number of exemplary embodiments illustrated in the drawing.

In the drawing

DETAILED DESCRIPTION OF THE PREFERRED EMBODIMENTS

Figure 1:
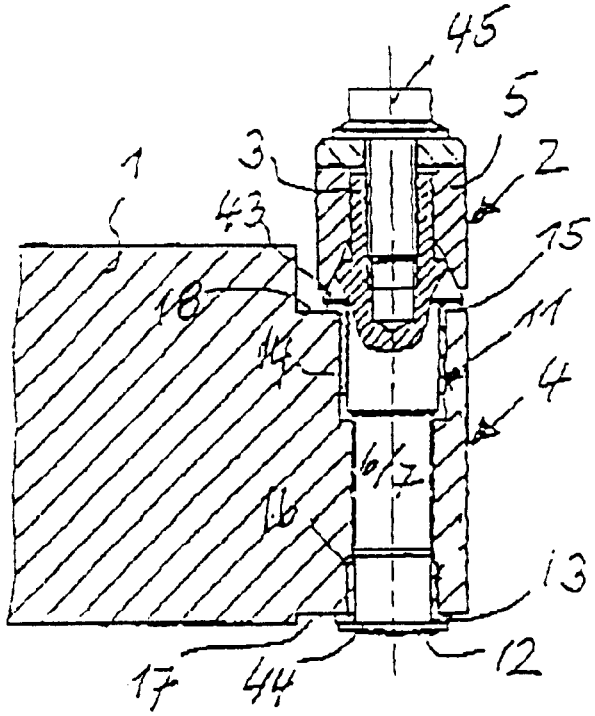
FIG. 1 shows a longitudinal section through a first embodiment of a demountable motor-vehicle door hinge which is equipped with a braking and holding function.

The motor-vehicle door hinges illustrated in the drawing each comprise a first hinge half 1 which can be fixed to the one door assembly part, door or door strut, and a second hinge half 2 which can be fixed to the other door assembly part, and also a hinge pin 3 which connects the two hinge halves 1 and 2 pivotably to each other. In all of the exemplary embodiments, the motor-vehicle door hinge illustrated in the drawing is designed as a separable hinge, each of the two hinge halves 1 and 2 only having one gudgeon 4 or 5 in each case. Furthermore, the hinge is in each case equipped with an integrated device, comprising a radially projecting rounded deviation of the hinge pin and a complementary cross-sectional shape of the gudgeon hole, in order to obtain a braking and holding force which increases progressively in the region of at least one selected opening angle and constitutes an obstacle to the further opening movement of the door. In this case, the hinge pin 3 is mounted rotatably in the first hinge half 1 and over part 6 of its longitudinal region, which reaches through the gudgeon 4 of the first hinge half 1, has a radially projecting rounded deviation 7 to which a complementary cross-sectional shape of the gudgeon hole is assigned. On both sides of its longitudinal section 6, the hinge pin 3 has longitudinal sections which each have a precisely cylindrical circumference and via which it is guided in a play-free and rotatable manner in the gudgeon 4 by means of bearing bushings which are designed as collar-type bushings 14 and 16 and are made of a maintenance-free bearing material. The hinge pin 3 is furthermore arranged secured against axial migration in the gudgeon 4 of the first hinge half 1, the securing of the hinge pin 3 against axial migration being formed on the one hand by a radial projection 43 and on the other hand by a securing means 44 which is placed on. The hinge pin 3 is fixed in the gudgeon 5 of the second hinge half 2 in a rotationally secure manner by means of an axially directed screw bolt 45, the screw bolt 45 being in engagement with the hinge pin 3 and resting on the free end surface of the hinge part of the hinge half 2. In all of the embodiments illustrated in the drawing, the hinge bearing arrangement accommodated in the hinge half 1 is sealed to the outside in a steam-tight manner.

In the embodiment illustrated in FIG. 1, the hinge pin 3 has, on both sides of its longitudinal section 6, longitudinal sections which in each case have an exactly cylindrical circumference and via which it is guided in a play-free and rotatable manner in the gudgeon 6 by means of bearing bushings designed as collar-type bushings 14 and 16 and made of a maintenance-free bearing material. The steam-tight sealing of the hinge bearing arrangement is formed by there being provided at that end of the gudgeon hole 11 which is assigned to the free end of the hinge pin 3 a radial deformation 12 of the hinge pin 3, which deformation fits over the radially positioned collar 13 or the collar-type bushing 16, the radial deformation 12 of the hinge pin 3, which at the same time also causes the hinge pin 3 to be braced axially with respect to the gudgeon 4, being designed in particular as a rivet and forming part of the means of securing the hinge pin 3 against axial migration. As a consequence of the axial prestress resulting from the riveting 12 of the hinge pin 3 with respect to the end surface 17 of the gudgeon, the radially positioned collar 15 of the collar-type bushing 14 is also braced between the radial projection of the hinge pin and the associated end surface 18 of the gudgeon, with the result that an absolutely steam-tight sealing of the hinge bearing arrangement is ensured by the axial bracing of the collars of the two collar-type bushings 14 and 16.

Figure 2:
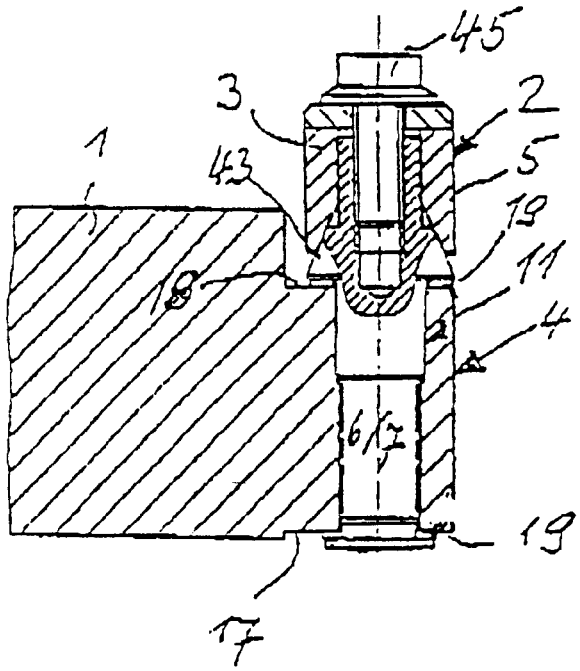
FIG. 2 shows a longitudinal section through a second embodiment of a demountable motor-vehicle door hinge which is equipped with a braking and holding function.

In the embodiment according to FIG. 2, the steam-tight sealing of the hinge bearing arrangement is obtained by the axial bracing of a respective run-on washer 19 against the two end surfaces 17 and 18 of the gudgeon 4, the axial bracing of the run-on washers against the two end surfaces 17 and 18 being brought about by means of a simultaneous axial bracing of the hinge pin 3 with respect to the gudgeon 4, and the axial bracing of the hinge pin 3 being obtained by the riveting 12 of the free end of the hinge pin 3.

Figure 3:
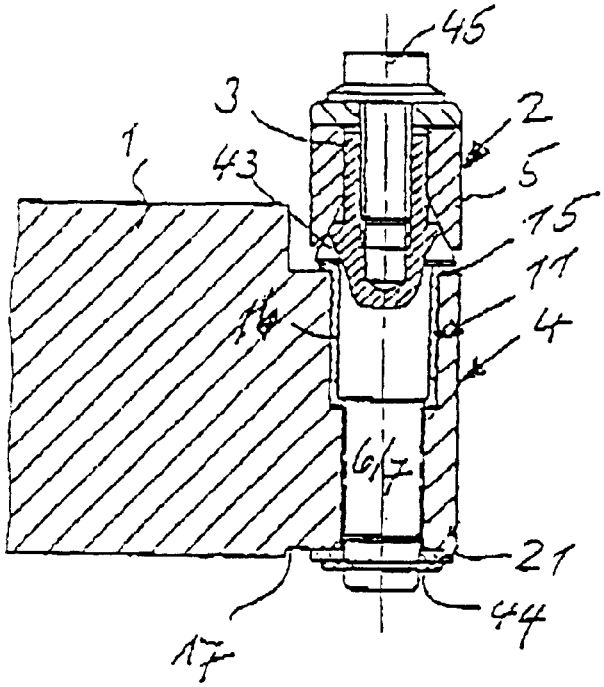
FIG. 3 shows a longitudinal section through a third embodiment of a demountable motor-vehicle door hinge which is equipped with a braking and holding function.

In the embodiment according to FIG. 3, the steam-tight sealing of the hinge bearing arrangement on that side of the gudgeon 4 which is assigned to the free end of the hinge pin 3 is obtained by the axial bracing of a sealing washer 21 against the end surface 17 of the gudgeon 4, and on the opposite side of the gudgeon 4 by clamping the radially positioned collar 15 of the collar-type bushing 16 between the radial projection of the hinge pin and the associated end surface 18 of the gudgeon. The axial bracing of the sealing washer 21 is also brought about here by means of a radial deformation 12 of the hinge pin 3, which deformation forms a rivet.

Figure 4:
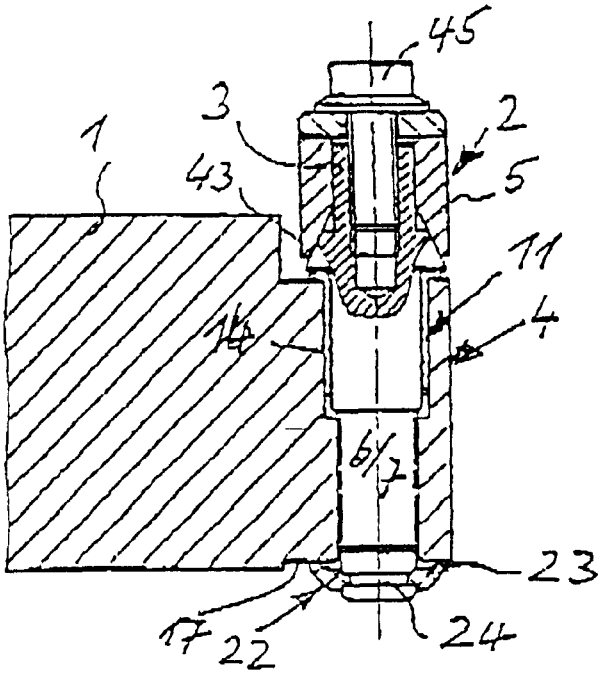
FIG. 4 shows a longitudinal section through a fourth embodiment of a demountable motor-vehicle door hinge which is equipped with a braking and holding function.

The design form according to FIG. 4 differs from that according to FIG. 3 basically by the fact that on that side of the gudgeon 4 which is assigned to the free end of the hinge pin 3 the steam-tight sealing is formed by a soft-material seal 22 bearing with a sealing lip 23 under prestress against the end side of the gudgeon 4 or hinge part, the soft-material seal 22. being supported against the hinge pin 3 by means of a bead 23 and an annular groove 24.

Figure 5:
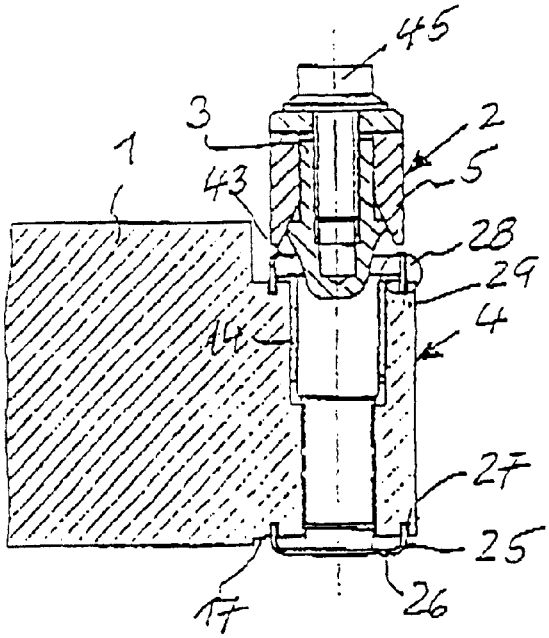
FIG. 5 shows a longitudinal section through an embodiment, which is equipped with contact-free sealing means, of a demountable motor-vehicle door hinge which is equipped with a braking and holding function.
Figure 6:
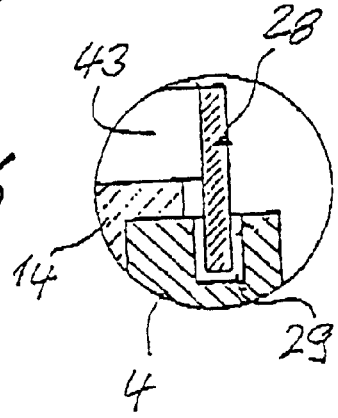
FIG. 6 shows an illustration of a section of FIG. 5 on an enlarged scale.

The embodiments illustrated in FIGS. 5 and 6 are based on the steam-tight sealing of the hinge bearing arrangement being constituted either as a whole or at least partially by contact-free sealing means, the contact-free sealing means for the steam-tight sealing being formed in each case by a labyrinth seal. In the embodiment according to FIG. 5, a first labyrinth seal comprises at one end a cap 26 which is placed in a sealing manner onto the free end of the hinge pin 3 and has a collar 25 coaxial to the hinge pin and at the other end an axial annular groove 27 which is arranged in that end surface of the gudgeon 4 which is assigned to the free end of the hinge pin 3, and the width of which groove corresponds to a multiple of the material thickness of the cap 26 which is placed onto the hinge pin 3. A second labyrinth seal comprises at one end a collar 28 which is fitted to a radial projection of the hinge pin 3 and is coaxial to the hinge pin 3, and an axial annular groove 29, which is assigned to the said collar, in the associated end surface of the gudgeon 4, the width of the annular groove 29 also corresponding here to a multiple of the material thickness of the collar 28, as can be seen in detail from the illustration of FIG. 6.

Figure 7:
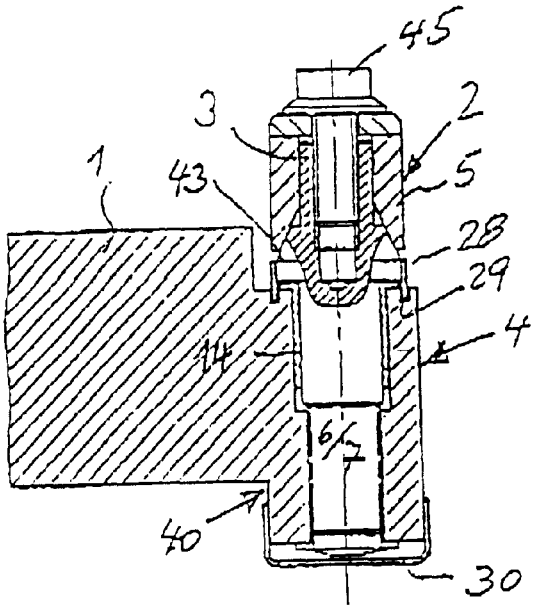
FIG. 7 shows a longitudinal section through a modified embodiment of a demountable motor-vehicle door hinge which is provided with contact-free sealing means and is equipped with a braking and holding function.

In the modified embodiment illustrated in FIG. 7, the steam-tight sealing on that side of the gudgeon 4 which is assigned to the free end of the hinge pin 3 is formed by a cap 30 which fits over the free end surface of the gudgeon 4 and bears in a sealing manner against the side surfaces 40 of the hinge half 1. A labyrinth seal corresponding to that of FIG. 6 is provided on the opposite end side of the gudgeon 4.

Figure 8:
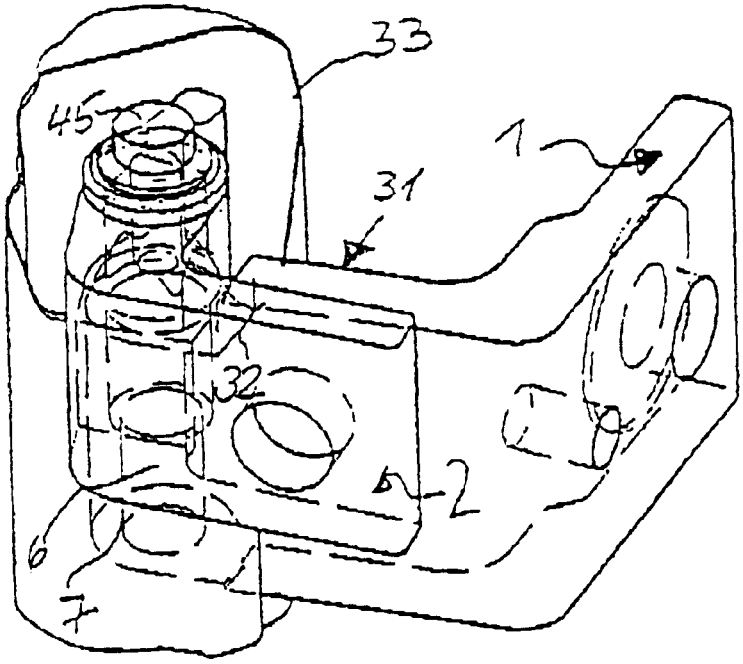
FIG. 8 shows a partially broken-open diagram of a demountable motor-vehicle door hinge which is equipped with a closed bellows fitting around the hinge parts of both hinge halves and in each case bearing in a sealing manner against the hinge leaves.
Figure 9:
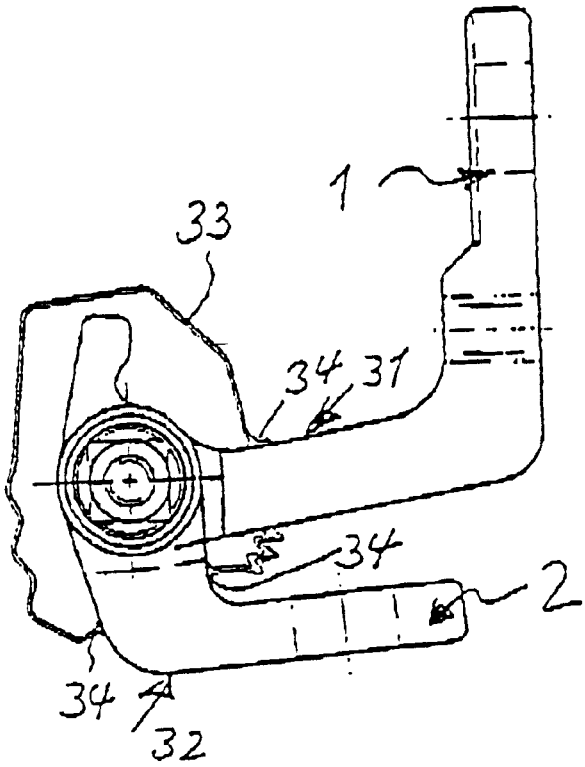
FIG. 9 shows a section through a motor-vehicle door hinge according to FIG. 8.

In the embodiment illustrated in FIGS. 8 and 9, the steam-tight sealing is formed by a closed bellows 33 which fits around the hinge parts, in particular the gudgeons, of both hinge halves 1 and 2 and in each case bears in a sealing manner against the hinge leaves 31 and 32. In this arrangement, the bellows 33 bears in each case in a sealing manner and in each case in the region of the hinge-leaf roots against the two hinge halves 1 and 2 via sealing lips 34. Door assembly part as defined herein includes any or all parts of a vehicle door, a door strut or any other part of a vehicle providing support for a vehicle door.

What is claimed is:

1. A motor-vehicle hinge having a holding and a braking function comprising:

a first hinge half fixable to a door assembly part, the first hinge half having a first gudgeon;

a second hinge half fixable to another door assembly part, the second hinge half having a second gudgeon having a hole; and a hingepin made of solid material and pivotably connecting the first hinge half to the second hinge half, the hingepin being connected to the first gudgeon in a rotationally secure manner and being mounted in the hole with a running fit, the hingepin having, at least over part of a longitudinal region assigned to the second gudgeon, a rounded cross-sectional profile deviating from a purely circular shape;

the hole being sealed with respect to the hingepin at both ends of the hole in a steamtight manner.

2. The motor-vehicle hinge as recited in claim 1 further comprising soft-material seals under radial prestress for sealing the hole.

3. The motor-vehicle hinge as recited in claim 1 further comprising sealing elements under axial stress for sealing the hole.

4. The motor-vehicle hinge as recited in claim 3 wherein the hingepin has a hinge axis, the second gudgeon has a gudgeon wall, and the sealing elements include a deformation of the hinge pin and the gudgeon wall, the deformation directed radially with respect to the hinge axis.

5. The motor-vehicle hinge as recited in claim 3 wherein the sealing elements include run-on washers braced axially against an end of the second hinge half and a free end of the hinge pin, the free end of the hinge pin having a deformation, the deformation directed radially with respect to a hinge axis of the hingepin.

6. The motor-vehicle hinge as recited in claim 3 wherein the sealing elements include run-on washers braced axially against an end of the second hinge half and clamping a radial collar of a bearing bushing.

7. The motor-vehicle hinge as recited in claim 3 wherein the sealing elements include soft-material seals which bear under prestress against an end of the second hinge half.

8. The motor-vehicle hinge as recited in claim 3 wherein the sealing elements include a cap fitting over a free end surface of the second hinge half, the cap bearing in a sealing manner against side surfaces of the second hinge half.

9. The motor-vehicle hinge as recited in claim 3 wherein the sealing elements include a closed bellows fitting around sections of both the first and second hinge halves.

10. The motor-vehicle hinge as recited in claim 1 further comprising a covering fitting over a head roller of the second hinge half for sealing the hole.

11. The motor-vehicle hinge as recited in claim 1 further comprising contact-free seals for sealing the hole.

12. The motor-vehicle hinge as recited in claim 11 wherein the contact-free seals include labyrinth seals.

13. The motor-vehicle hinge as recited in claim 12 wherein the labryrinth seals have a first end having a cap placed onto a free end of the hingepin and a collar coaxial to the hingepin, and a second end having a second collar fitted to a radial projection of the hingepin, the second collar being coaxial to the hingepin, the first and second collars each being assigned an axial annular groove of the second hinge half.

* * * * *